United States Patent [19]

Tracy

[11] Patent Number: 4,534,092

[45] Date of Patent: Aug. 13, 1985

[54] APPARATUS FOR JOINING LENGTHS OF METAL STRIP

[75] Inventor: John A. Tracy, Kingston, Canada

[73] Assignee: Alcan International Limited, Montreal, Canada

[21] Appl. No.: 281,910

[22] Filed: Jul. 9, 1981

[30] Foreign Application Priority Data

Jul. 16, 1980 [GB] United Kingdom ..... 8023234

[51] Int. Cl.[3] ..... B23P 11/00; B21D 39/03

[52] U.S. Cl. ..... 29/21.1; 29/432; 29/521; 29/798; 72/325

[58] Field of Search ..... 72/325, 324, 326, 332, 72/327, 333, 413, 415, 477; 83/620, 640, 641, 695–696; 29/21.1, 798, 521, 432, 6.2

[56] References Cited

U.S. PATENT DOCUMENTS

| | | | |
|---|---|---|---|
| 493,791 | 3/1893 | Schurig | 72/326 |
| 689,687 | 12/1901 | Newcome | 83/694 |
| 928,610 | 7/1909 | Klock | 29/6.2 |
| 1,449,385 | 3/1923 | Dietereich | 72/326 |
| 1,949,066 | 2/1934 | Waner | 83/502 |
| 1,994,137 | 3/1935 | Leguillon | 83/502 |
| 2,729,995 | 1/1956 | Friedman et al. | 72/409 |
| 3,129,489 | 4/1964 | Nelson | 29/21.1 |
| 3,284,873 | 11/1966 | Noel | 29/21.1 |
| 3,584,495 | 6/1971 | Rausina | 72/333 |
| 4,130,927 | 12/1978 | Bengtsson et al. | 29/798 |

FOREIGN PATENT DOCUMENTS 873237 4/1953 Fed. Rep. of Germany ..... 72/325

*Primary Examiner*—Daniel C. Crane

*Attorney, Agent, or Firm*—Cooper, Dunham, Clark, Griffin & Moran

[57] ABSTRACT

A joint between the overlapped ends of two metal strips comprising strip portions defined by parallel straight longitudinal slits cut through the thickness of both strips, adjacent strip portions being deflected in opposite directions to define a transverse passage and a lock pin located in said passage is produced by apparatus comprising a pair of parallel cutter bars arranged on opposite sides of the path of the metal strip carried by supports, provided with means for moving said cutter bars towards and away from each other, each cutter bar carrying a plurality of laterally spaced cutter elements, the space between adjacent cutter elements on each cutter bar being substantially equal to the thickness of width of the cutter elements on the other cutter bar, the cutter elements on each cutter bar being arranged to mesh with the cutter elements on the other cutter bar, each cutter element having at least a part-circular periphery, each cutter bar being rotatable in relation to its support between a series of positions and being provided with means for holding it against rotation in a plurality of positions. Some at least of the cutter elements are provided with arcuate recesses in their periphery. When these recesses are indexed to face the opposed cutter bar, such cutter elements are rendered inoperative.

2 Claims, 7 Drawing Figures

FIG. 1
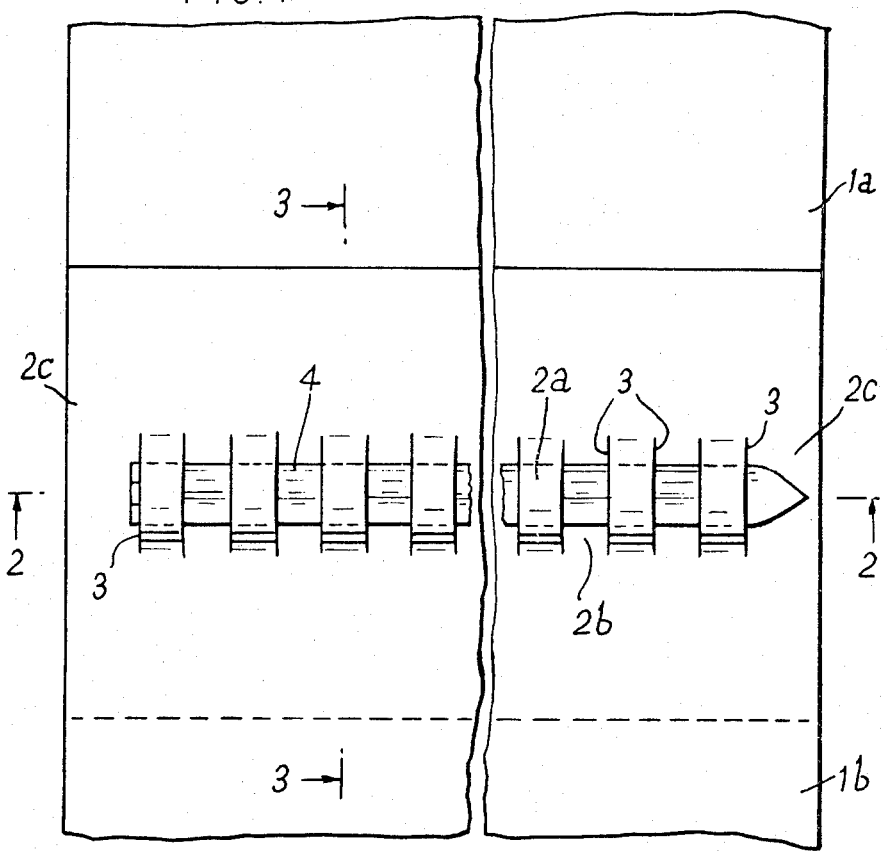
FIG. 2
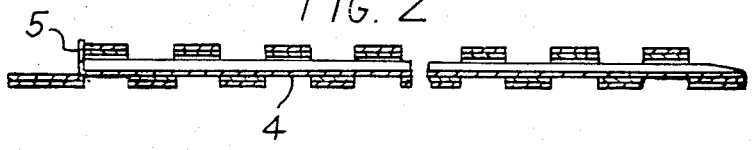
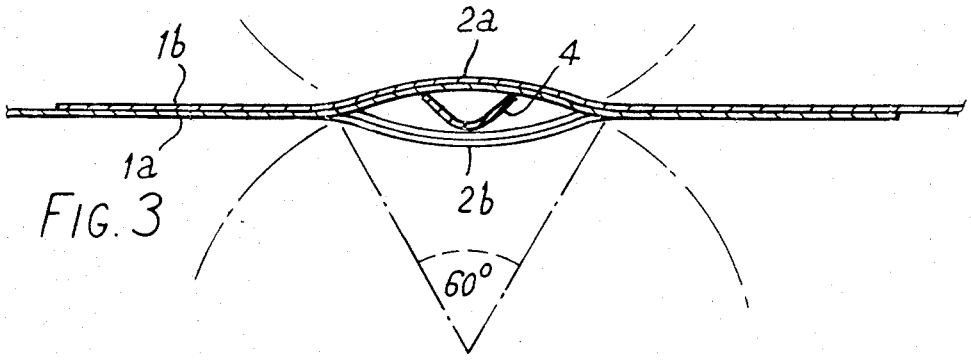
FIG. 3

APPARATUS FOR JOINING LENGTHS OF METAL STRIP

The present invention relates to joining lengths of metal strip and in particular to a novel form of joint for joining the tail end of one strip length to the front end of a following strip and to an apparatus for forming the novel form of joint.

In many processes for the continuous treatment of metal strip it is necessary to join the nose end of a fresh coil of metal strip to the tail end of an exhausted coil to avoid the necessity of halting the process and threading the fresh coil through the treatment apparatus. In forming the joint it is necessary to halt the feed of the tail of the exhausted coil without halting the feed of strip through the treatment apparatus. To enable this to be done it is conventional practice to provide a loop of strip material between the strip uncoiler and the treatment apparatus to act as a reserve of strip material which can be drawn on while the tail of the strip is halted. It will be understood that the joint must be formed before exhaustion of the reserve material in the loop and in consequence all practicable forms of joint must be susceptible of being formed very quickly, that is to say in time periods of less than one minute.

It is already known to join successive lengths of metal strip in continuous processing systems by overlapping the end portions of successive lengths and joining them by welding or rivetting. There are certain objections to both these techniques for joining lengths of light metal strip, such as aluminium, and it is more usually preferred to join aluminium strip lengths by a method which involves cutting a series of slits, arranged side-by-side in the overlapped end portions of the two strips, to form a series of laterally projecting tongues. When the portion of the strips between two slits is deflected and the leading strip is pulled forward, the tongue on one strip engages in the slit in the other strip to interengage the two strips for longitudinal movement.

This method of connecting successive lengths of strip requires relatively expensive and specialised tooling for cutting the slits in the overlapped strip ends. Such tooling is somewhat difficult to sharpen. Moreover the strength of the joint is somewhat less than desirable if the resulting joint passes through a zone of high temperature which softens the metal strip.

It is also known to join lengths of metal strip by forming a series of parallel longitudinally-extending slits in the overlapped strip ends and pressing the portions of the strips between adjacent slits outwardly, laterally adjacent portions being pressed outwardly in opposite directions so as to form a transverse channel, through which a round rod or bar may be inserted to connect the two strips.

The joint of the present invention is similar to this previously known joint, but is modified in certain slight but important respects which allows the employment of simplified slit-cutting equipment and also allows the possibility of extended intervals between successive tool sharpenings.

In the modified joint of the present invention the maximum deflection of the strip portions between a pair of slits is no more than about 10–15% of the length of the slits, the strip portions being essentially arcuate in shape. The pins for joining the two strips are conveniently made from thin metal strip, either flat or formed into a shallow V for greater stiffness. They are usually wider than they are thick. The pins are conveniently pointed at one end for ease of insertion. The arcuate strip portions extend through 45°–90°, most usually 60°, and this enables the slits to be cut and the strip portions to be formed into arcuate shape by use of simplified tooling, as explained below. The ends of the strip portions are usually somewhat straightened as a result of spring-back after cutting.

The joint is very strong under longitudinal tension and the shallowness of the joint permits the joined strip lengths to be drawn through processing apparatus without difficulty, and also allows some degree of hingeing movement at the joint.

In its simplest form an apparatus for forming a joint between the ends of successive lengths of metal strip, which travel through a processing apparatus, comprises a pair of parallel cutter bars, carried by supports which are movable towards and away from each other and arranged on opposite sides of the path of the strip, each cutter bar carrying a plurality of spaced cutter elements, the space between adjacent cutter elements on each cutter bar being substantially equal to the thickness or width of the cutter elements on the other cutter bar, the cutter elements on each cutter bar being arranged to mesh with the cutter elements on the other cutter bar, each cutter element having at least a part-circular periphery, each cutter bar being rotatable in relation to its support between a series of positions and being provided with means to hold it against rotation in a plurality of positions. In the simplest form of the invention, intended for joining strip of a single width, the cutter elements on both cutter bars, which are arranged to move perpendicularly to the path of the metal strip, are simple circular cutter discs, that is to say each cutter is in the form of a cylinder of an axial length which is small in relation to its diameter. It is only necessary to turn a cutter bar through an appropriate angle to bring a fresh part of the sharp cutter edges into operation so that the cutter elements only require resharpening at long intervals and the simple disc form of cutter is simpler to resharpen than more complex forms of cutter required for the formation of some other forms of joint.

In operation the cutters on the two cutter bars cooperate to cut a series of parallel, longitudinally-extending slits in the overlapped ends of two lengths of metal strip and simultaneously the portions lying between adjacent slits are deformed into an arcuate shape around the periphery of the cutter disc spanning the interval between the two slits. In consequence the strip portions between slits are alternately deflected upward or downward. It is preferred that the cutters are arranged so that the edge regions of the strips are deflected downward to facilitate the insertion of the connecting pin.

Most apparatus for continuous processing of metal strip is intended to handle strip falling within a wide range of widths and it is found undesirable to form slits very close to the edges of the strip, since the strip portions between the outermost slit and the strip edge may break to form sharp-pointed slivers. These slivers may become embedded in fabric-covered or rubber-covered rolls downstream of the jointing operation and this in turn may lead to damage of the strip passing over the embedded slivers. To avoid this possibility it is preferred to arrange that selected cutters on one of the cutter bars, preferably the lower cutter bar, are inoperative in a selected position of the cutter bar. This may be achieved by providing that the cutting edges of such cutters be only part-circular. By rotating a cutter of the lower bar to a position where it is inoperative, it does not co-operate with the corresponding pair of cutters on the upper bar to form a pair of slits, while the peripheries of the cutter discs on the upper bar still perform their function of pressing downwardly on the upper surface of the strip to form a channel for ease of insertion of the pin. This function is best achieved by providing that the inoperative portion of a cutter of the lower bar is a concave cut-out having a curvature corresponding to the cutter of the upper bar, so as to provide a concave support surface for the overlapped strips during the formation of the channel by the co-operating peripheries of the cutters of the upper bar.

Referring now to the accompanying drawings,

FIG. 1 is a plan view of a joint in accordance with the invention.

FIG. 2 is a section on line 2—2 of FIG. 1,

FIG. 3 is a section on line 3—3 of FIG. 1,

Figure 4:
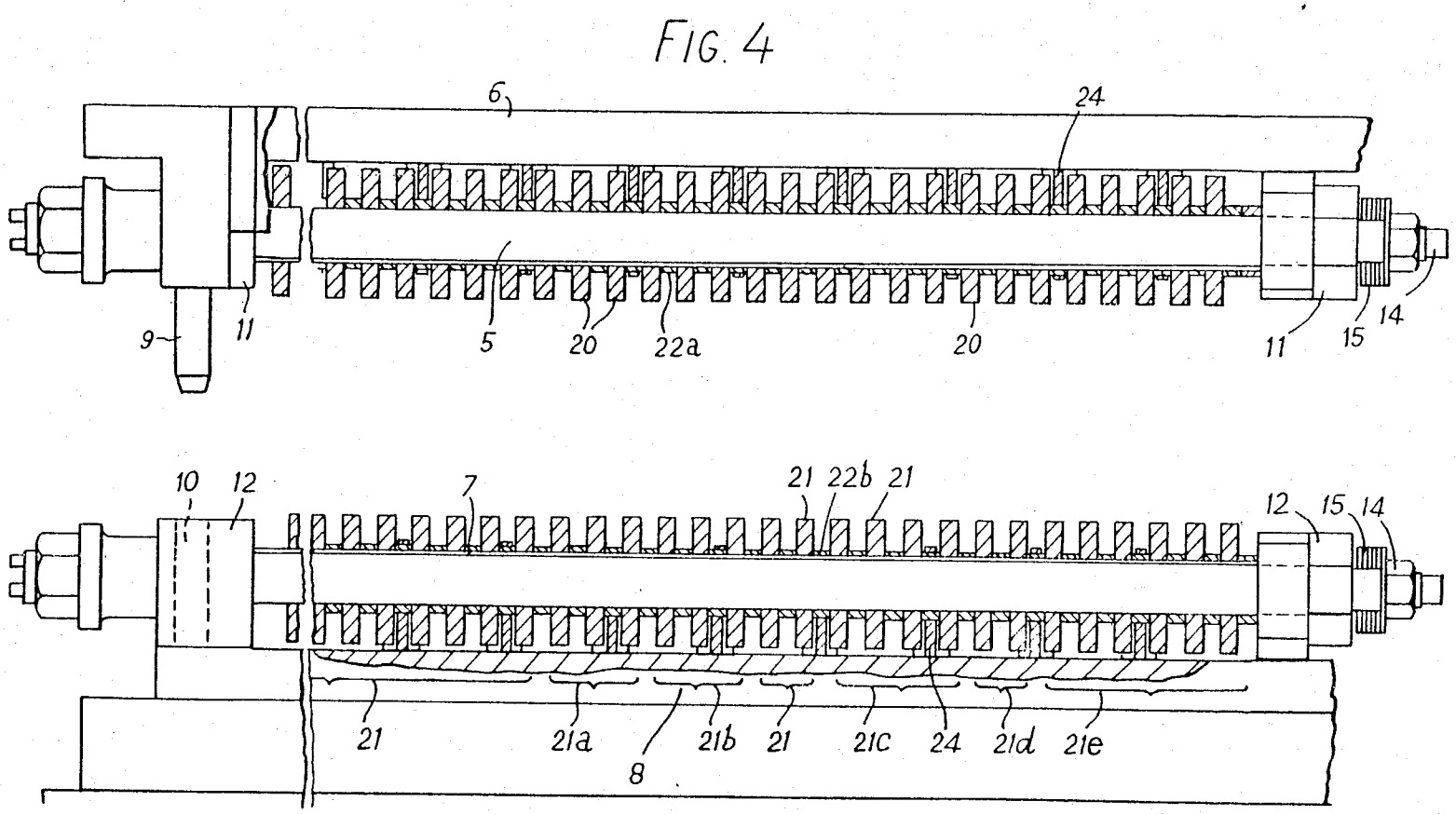
Figure 5:
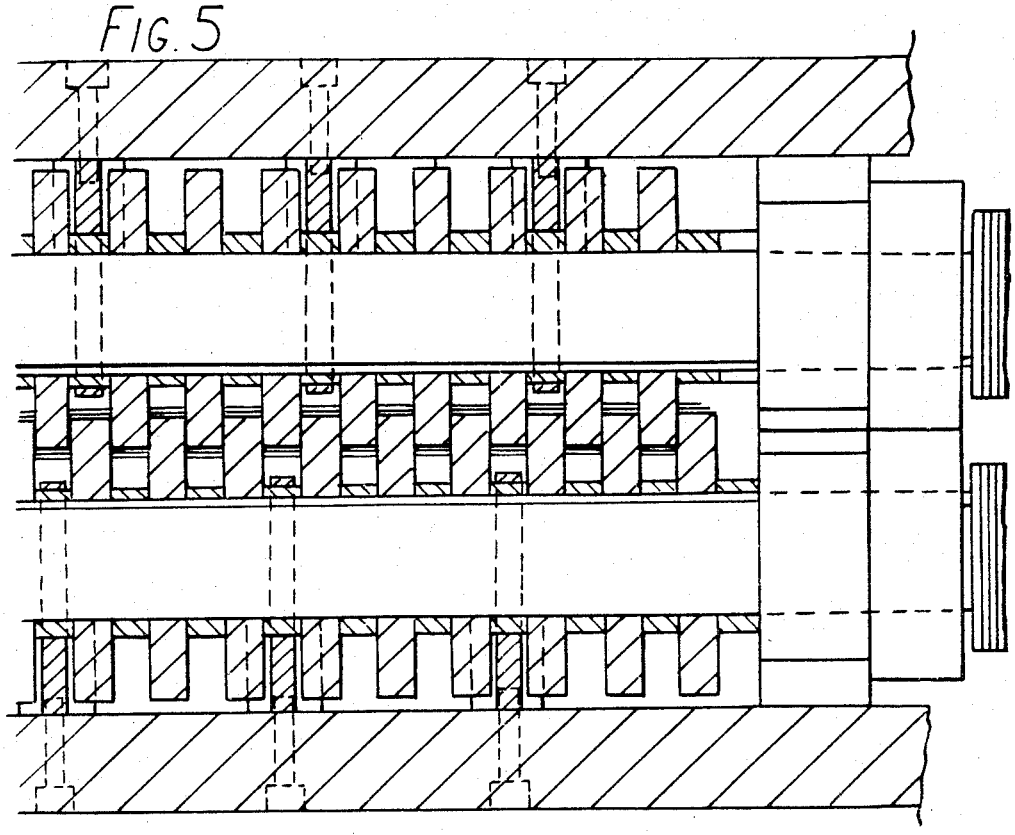
Figure 5:
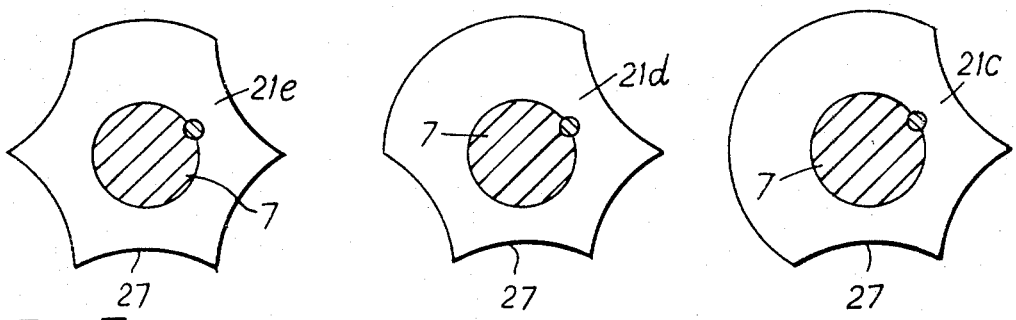
Figure 7:
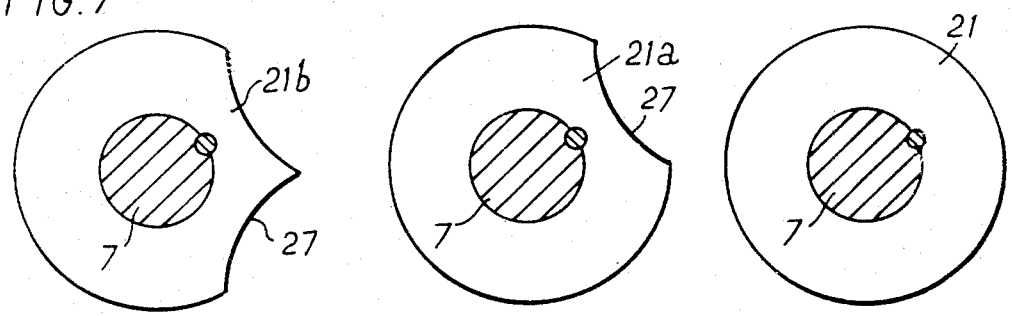
Figure 6:
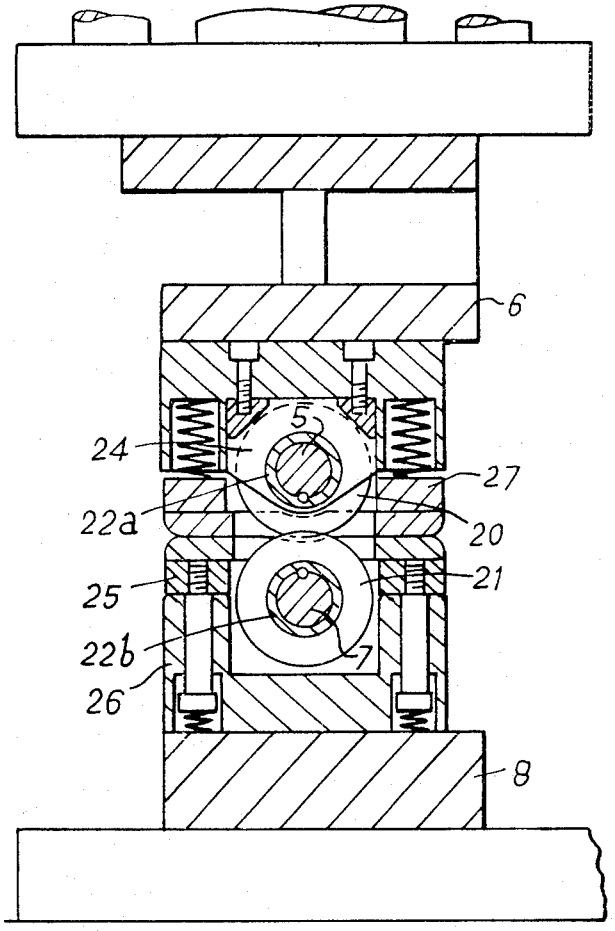

FIG. 4 is a view of the upper and lower cutter bars of a press employed for forming a joint in accordance with the invention, FIG. 5 is a part view of the cutter bars of FIG. 4 in the operative position and on a larger scale, FIG. 6 is a cross section of the cutter bars of FIG. 4 in the operative position and in the centre of the press, FIG. 7 illustrates the shapes of the cutters employed on the lower cutter bar at various locations on such bar.

Referring firstly to FIGS. 1–3, the overlapped ends of metal strips 1*a* and 1*b* are locked to one another by means of a pin 4, which passes through eyes formed by alternately deflecting portions 2*a*, 2*b* in upward and downward directions. The portions 2*a*, 2*b* are defined by a series of parallel slits 3 cut through the strips 1*a*, 1*b*. The portions 2*a* and 2*b* are of approximately arcuate form and subtend an angle of approximately 60°. The outermost slits 3 are spaced well inwardly from the side edges of the strips 1*a* and 1*b* so as to leave edge portions 2*c*, which have approximately the same curvature as the portions 2*b*, so as to constitute a trough for the insertion of a pin 4. The pin 4 may be a shallow U-shaped strip, having an upturned tail 5, as shown in FIGS. 2 and 3. Alternatively it may be formed of a pointed flat metal strip, with or without an upturned tail. The illustrated joint provides a very satisfactory and secure means for joining strip in a metal strip processing system.

The apparatus for cutting the slits 3 and for imparting an arcuate shape to strip portions 2*a*, 2*b*, 2*c* is illustrated in FIGS. 4–7. It comprises an upper cutter bar 5 secured to a vertically movable press platen 6 and a lower cutter bar 7 secured to a stationary press platen 8. The platen 6 is provided with one or more guide pins 9 which enter a corresponding guideway or guideways 10 to maintain alignment between the cutter bars 5 and 7.

The bars 5 and 7 are respectively rotatable in bearings 11 and 12 at their two ends, but are releasably held against rotation by clamp nuts 14, acting on a pack of Belleville washers 15. When the nuts 14 are slackened the bars 5 and 7 may be rotated. The upper bar 5 may be locked up at any selected position but the lower bar 7 may be locked only in one of six indexed positions.

The cutters 20 carried by the upper cutter bar are keyed thereto and are all plain discs. The spacing between adjacent cutters 20 is substantially equal to the width (thickness) of the cutters 21, secured to the lower cutter bar and the spacing between adjacent cutters 21 is substantially equal to the width of the cutters 20. The width of the cutters 20 and 21 is preferably equal and the spacing between adjacent cutters is maintained by circular collars 22*a*, 22*b*, respectively keyed to the upper bar 5 and lower bar 7.

Both bars 5 and 7 are supported at frequent intervals, preferably at every third cutter, by a fixed bearing element 24 in which the corresponding spacer 22*a* or 22*b* can freely turn, as illustrated in FIG. 6 where spacer 22*a* turns in bearing element 24. As will be seen also from FIG. 6 a spring-loaded stripper element 25, which bolts on a fixed support 26, determines the path of the overlapped strip ends 1*a*, 1*b* during the formation of the joint. The strips are cleared from the cutters of the lower and upper bars by stripper elements 25 and spring-loaded stripper elements 27, carried by the upper platen 6, respectively.

As already indicated the cutters 21 carried by the lower cutter bar 7 are of different shapes, ranging from the plain disc 21 through 21*a*, 21*b*, 21*c*, 21*d* and 21*e*, shown in FIG. 7. As will be seen the cutters 21*a*, 21*b*, 21*c*, 21*d*, 21*e* are formed respectively with one to five 60° concave recesses 27, having a concave curvature corresponding to that of the periphery of disc 21. The remainder of the edges of the discs 21*a*–21*e* may be considered as forming a number of 60° arcuate cutting edges to constitute a cutter section at the periphery of the cutter. The recesses in cutters 21*a*–21*d* could be arranged to provide at least two cutter sections at the periphery.

Although in FIG. 4 all cutters 21 on cutter bar 7 are shown as being of the same shape, they are in fact arranged in groups of different shapes as indicated in FIG. 4. By indexing the bar 7 to the correct position strips of a selected width may be slit without the outermost slits being too close to the edge.

In FIG. 4 only half of each cutter bar is shown and the cutters are arranged substantially symmetrically in relation to the mid-point of each bar. The narrowest strip to be slit by the apparatus will be just wider than the central group of cutters 21. By indexing the bar so that recess 27 of cutters 21*a* is facing the cutters 20 of the upper cutter bar 5, the cutters 21*a* and the coacting cutters 20 are rendered inoperative to cut slits, while remaining operative to form the strip.

By indexing the bar one position in an anti-clockwise direction (as seen in FIG. 7) the cutters 21*b* are rendered inoperative while the cutters 21*a* are again rendered operative. This is an appropriate position where one of the standard strip widths to be slit slightly extends beyond the outer limit of cutters 21*a*.

Where no standard strip falls within certain strip width ranges it may be convenient to employ a group of plain disc cutters 21, as illustrated in one off-middle location in FIG. 4.

In addition to the advantage of being able to adjust for different strip widths without risk of leaving slits too close to the strip edge, the present system is found to have other advantages over prior art systems.

In addition to the simplicity of regrinding circular (including part-circular) cutters, the cutter bar arrangement allows a whole set of cutters to be mounted on the platen as a single assembly. This greatly reduces downtime as compared with arrangements in which specially-shaped cutters require to be mounted individually.

It is also found that the cutter life, between regrinds, is greatly extended as compared with prior art systems in which the slits are cut so as to provide laterally extending tongues. The central cutters on the lower cutter bar experience the greatest overall wear, because they are always operative, whatever the width of the strip to be joined. However different portions of their periphery are used, according to the strip width and the correspondingly indexed position of cutter bar 7.

As compared with prior art systems above referred to the cutter system of the present invention requires a lower platen force and is not bulky, so that it is simple to instal in the processing line.

It has been found possible with the described system to join strip in a wide range of thickness with a single pair of cutter bars. The resulting joint is very strong and unslit margins of up to one tenth of the strip width may be left when joining relatively wide strips.

I claim:

1. Apparatus for forming a joint between the ends of successive lengths of metal strip which travels through a processing apparatus comprising a pair of parallel cutter bars arranged on opposite sides of the path of the metal strip and rotatably mounted on supports, provided with means for moving said cutter bars towards and away from each other for application of shearing and forming forces, each cutter bar carrying a plurality of laterally spaced cutter elements non-rotatably mounted thereon, the space between adjacent cutter elements on each cutter bar being substantially equal to the thickness or width of the cutter elements on the other cutter bar, the cutter elements on each cutter bar being arranged to mesh with the cutter elements on the other cutter bar, each cutter element having at least a particular periphery, each cutter at selected positions on at least one cutter bar having at least one part-circular cutter section at its periphery and at least one concave peripheral recess of curvature corresponding to the curvature of said cutter section, each cutter bar being provided with means for holding it against rotation in relation to its support in a plurality of operative positions during movement of said cutter bars towards and away from each other.

2. Apparatus according to claim 1 in which the cutters of each cutter bar are spaced apart by spacer collars secured to the cutter bar, at least a proportion of said collars being mounted for rotation in bearings carried by the co-operating support for said cutter bar.

* * * * *